United States Patent [19]

Foshee

[11] Patent Number: 4,773,240

[45] Date of Patent: Sep. 27, 1988

[54] LOCK WITH FORCE-OVERRIDE ASSEMBLY

[75] Inventor: William R. Foshee, Noblesville, Ind.

[73] Assignee: Best Lock Corporation, Indianapolis, Ind.

[21] Appl. No.: 920,753

[22] Filed: Oct. 20, 1986

[51] Int. Cl.[4] ..... E05B 13/10

[52] U.S. Cl. ..... 70/222; 70/224; 70/422; 70/380

[58] Field of Search ..... 70/422, 222–224, 70/380, 381

[56] References Cited

U.S. PATENT DOCUMENTS

| | | | |
|---|---|---|---|
| 1,516,152 | 11/1924 | Dumont | 70/422 |
| 1,565,754 | 12/1925 | Orth | 70/422 |
| 1,611,940 | 12/1926 | Ohmer | 70/422 |
| 1,871,169 | 8/1932 | Floraday | 70/222 |
| 1,897,523 | 2/1933 | Marple | 70/222 |
| 1,899,997 | 3/1933 | Sullivan | 70/222 |
| 3,442,102 | 5/1969 | Butts | 70/422 X |
| 3,566,633 | 3/1971 | Borck | 70/422 X |
| 3,566,634 | 3/1971 | Borck | 70/422 X |
| 3,922,896 | 12/1975 | Kagoura | 70/223 |
| 4,195,502 | 4/1980 | Best et al. | 70/224 |
| 4,370,875 | 2/1983 | Piroinen | 70/422 |
| 4,394,821 | 7/1983 | Best et al. | 70/422 |
| 4,428,570 | 1/1984 | Foshee et al. | 267/164 |
| 4,550,581 | 11/1985 | Best et al. | 70/422 |
| 4,655,059 | 4/1987 | Best et al. | 70/224 |
| 4,679,420 | 7/1987 | Yang | 70/422 |

FOREIGN PATENT DOCUMENTS

| | | | |
|---|---|---|---|
| 151081 | 8/1985 | European Pat. Off. | 70/222 |
| 42529 | 8/1933 | France | 70/223 |
| 47581 | 2/1930 | Norway | 70/223 |
| 49311 | 9/1931 | Norway | 70/223 |

*Primary Examiner*—Gary L. Smith
*Assistant Examiner*—Suzanne L. Dino
*Attorney, Agent, or Firm*—Barnes & Thornburg

[57] ABSTRACT

A torque-releasable door handle assembly is provided for normally rotating a bolt-retracting sleeve to operate a door latching system. The door handle assembly includes a body for coupling to the bolt-retracting sleeve and a handle shell mounted on the body for rotational movement thereabout. A drive assembly is provided for yieldably connecting the body and handle shell to establish a normal driving connection so that the body is rotated normally to rotate the bolt-retracting sleeve and operate the door latching system in response to rotation of the handle shell. The drive assembly is configured to release the normal driving connection between the body and the handle shell in response to application of a rotation-inducing torque to the handle shell in excess of a predetermined amount. In preferred embodiments, the drive assembly includes a matched pair of mateable female and male drive rings positioned in a space between an exterior surface of the body and an interior surface of the handle shell. The male drive ring is reciprocable in the space away from a torque-transmitting position in engagement with the female drive ring toward an inactive position in spaced relation to the female drive ring in response to said excessive torque.

23 Claims, 2 Drawing Sheets

LOCK WITH FORCE-OVERRIDE ASSEMBLY

BACKGROUND AND SUMMARY OF THE INVENTION

This invention relates to door lock mechanisms, and particularly to a drive assembly for connecting a door handle shell or the like to a handle body that is coupled to a door latching system and adapted to disconnect under conditions of excessive torque to prevent the transmission to the door lock mechanism of excessive torque applied to the door handle. As used herein, the term "handle" is intended to include levers, knobs, and the like.

Door locks are subject to attack by the exertion of high torque on the handle sufficient to damage or override the lock mechanism and thus to jeopardize the security of the lock. Levered handles are particularly susceptible to the application of such excssive torque, since a strong person may be able to twist the lever handle manually with sufficient force to apply such high torque. Lever handles are also liable to attack by the application of force with the use of a tool applied to the projecting lever of the handle. Nevertheless, levered handles are desirable and in some cases mandatory to facilitate operation of door locks by handicapped or other persons who are not able to grip and turn a round knob.

Door handles having lock drive assemblies adapted to engage and rotate a bolt-retracting sleeve under normal operating torque but to release under excessive torque permitting the door handle to rotate with respect to the bolt-retracting sleeve are known. Conventional torque-releasable drive assemblies typically provide a releasable connecting directly between the door handle and the bolt-retracting sleeve itself. For example, a frangible drive coupling a knob to a knob sleeve and having drive lugs configured to shear in the shear region between the knob and sleeve under excess torque is disclosed in U.S. Pat. No. 4,550,581 to Best et al. In addition, U.S. Pat. No. 4,394,821 to Best et al. discloses a positive driver coupling a knob to a knob sleeve that is spring-biased to its driving position and cammed under excessive torque to a retracted position to release the normal drive connection between the knob and the knob sleeve.

One object of the present invention is to provide a torque-releasable drive assembly that is spring-biased to establish a normal driving connection and configured to ensure that application of torque to the handle in excess of a predetermined amount consistently acts to release the normal driving connection.

Another object of the present invention is to provide a torque-releasable handle assembly having a spring-biased camming driver that is easily resettable to a normal operating position following each application of excessive torque to the handle.

In accordance with the present invention, a torque-releasable door handle assembly is provided for normally rotating a bolt-retracting sleeve to operate a door latching system. The door handle assembly includes a body for coupling to the bolt-retracting sleeve and a handle shell mounted on the body for rotational movement thereabout. Drive means is provided for yieldably connecting the body and handle shell to establish a normal driving connection so that the body is rotated normally to rotate the bolt-retracting sleeve and operate the door latching system in response to rotation of the handle shell. The drive means is configured to release the normal driving connection between the body and the handle shell in response to application of a rotation-inducing torque to the handle shell in excess of a predetermined amount.

In preferred embodiments, the drive means includes a matched pair of mateable drive rings positioned in a space between an exterior surface of the body and an interior surface of the handle shell. A female drive ring includes a plurality of lug-receiving recesses. The female drive ring is positioned in the space to present its lug-receiving recesses in an axially inward door-facing direction and is coupled to the body for rotation therewith. A companion male drive ring includes a plurality of drive lugs shaped to engage the lug-receiving recesses of the female drive ring. The male drive ring is positioned in the space to present its drive lugs toward the female drive ring and is coupled to the handle shell for rotation therewith. In addition, the male drive ring is reciprocable in the space between an inactive position in spaced relation to the female drive ring and a torque-transmitting position in engagement with the female drive ring.

The drive means further includes spring means for yieldably biasing the male drive ring toward its torque-transmitting position to establish a normal driving connection between the body and the handle. The male drive ring is moved against the spring means toward its inactive position to release the normal driving connection in response to application of a rotation-inducing torque to the handle shell in excess of a predetermined amount.

In one embodiment of the present invention, the male drive ring is coupled to a radially inwardly-extending annular lip of the handle shell and the spring means acts directly between the male drive ring and the annular lip. In another embodiment, the male drive ring is a part of a subassembly coupled to an interior surface of the handle shell and the spring means is resiliently trapped within the subassembly between the male drive ring and an opposite end causing the opposite end to abut a radially inwardly-extending lip of the handle shell in biased relation.

One feature of the present invention is the provision of a handle assembly having torque-releasable drive means for yieldably interconnecting adjacent handle members to establish a normal driving connection that is releasable under excess torque to protect its companion door-latching system from damage during an attack on the security of the lock or other improper usage. This feature is positioned in a radially-outer location in the handle assembly itself and advantageously replaces conventional torque-releasable drivers that are often situated in interior regions of the door lock mechanism and interconnect a knob and a bolt-retracting knob sleeve. The novel door handle assembly of the present invention is more easily assembled, lubricated, and otherwise serviced than conventional torque-releasable drivers. In addition, provision of a spring-biased driver makes it unnecessary to disassemble and replace conventional frangible drivers that are broken during an attack following each instance of breakage.

Another feature of the present invention is the provision of a pair of separate drive rings in the handle assembly that are mateable to establish the normal driving connection. These companion drive rings advantageously provide broad mateable engagement surfaces that spread the biasing load generated by the spring means over a large contact area to lengthen the operating life of the novel torque-releasable drive means in comparison to known torque-releasable drive means having a small engagement region defined, for example, by one or two small lugs in engagement with a bolt-retracting sleeve or the like.

Another feature of the present invention is the provision of spring means for yieldably biasing a reciprocable drive ring toward a nonreciprocable drive ring to establish the normal driving connection. Advantageously, the novel spring means can be oriented to act along a longitudinal axis established by the handle body and shell to apply a substantially uniform biasing pressure to the reciprocable drive ring so that the normal driving connection is consistently released in response to application of a rotation-inducing torque to the handle shell in excess of a selected torque magnitude. This feature advantageously improves the camming operation of the spring-biased drive rings in that the threshold torque which must be applied to the handle shell to cam the reciprocable drive ring to a disengaged position is substantially constant.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
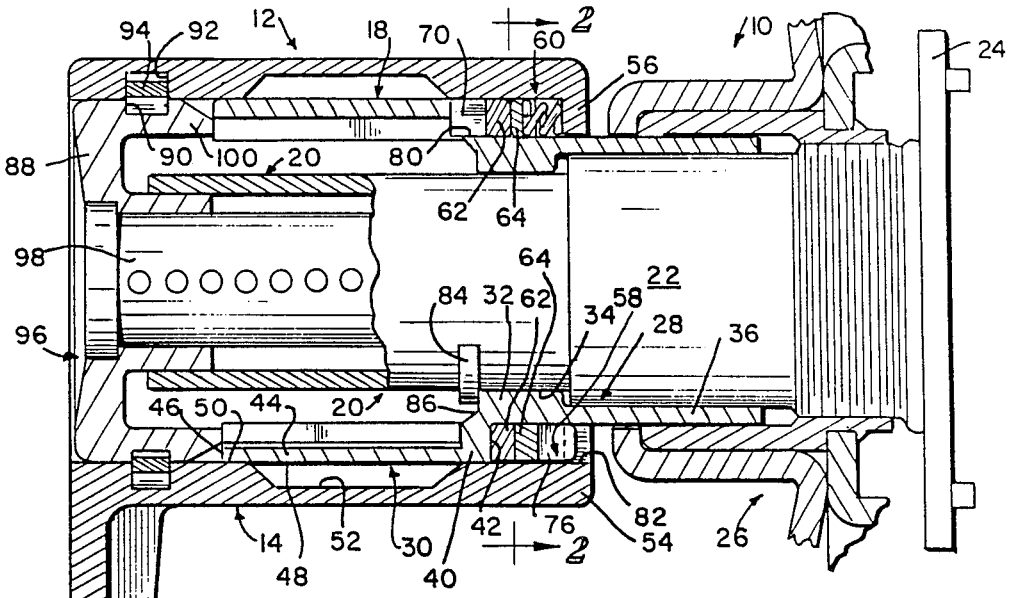
FIG. 1 is a horizontal axial section of a cylindrical lock mechanism having a torque-releasable drive assembly in accordance with a first embodiment of the present invention showing a reciprocable drive ring in its normal driving position.

The lock mechanism 10 shown in FIGS. 1-4 comprises a door handle 12 having a handle shell 14 formed to carry an operating lever 16 and a handle body 18 mounted on a generally cylindrical knob sleeve 20. The sleeve 20 is mounted for rotation in a hub 22 fixed to a chassis side plate 24 of a cylindrical lock mechanism and configured to engage a retractor (not shown) for retracting the bolt (not shown) of a door, as more fully shown in U.S. Pat. No. 3,955,387 to Best et al. A trim ring assembly 26 is threaded on the outside of hub 22 and extends in an axially-outward direction into overlapping relation with the handle body 18.

The handle body 18 includes a hollow neck 28 and a hollow core housing 30. The hollow neck 28 has a relatively thick portion 32 in rotative bearing engagement with an outer surface 34 of the bolt-retracting sleeve 20. Inward beyond such thick portion 32, the hollow neck 28 has a thinner portion 36 which is telescopically received between the trim ring assembly 26 and the axially outer end of hub 22. The hollow core housing 30 extends in an axially outward direction from the thick portion 32 of the hollow neck 28. The hollow core housing 30 includes an annular flange 40 extending in a radially outward direction to provide an axially inwardly-facing surface 42 and a substantially cylindrical side wall 44 extending in an axially outward direction from the annular flange 40 and terminating at circular end face 46.

The handle shell 14 includes an interior wall 50 positioned in rotative bearing engagement with an exterior surface 48 of cylindrical side wall 44. A depression 52 is formed in interior wall 50 to reduce the size of the rotative bearing engagement region between the handle shell 14 and the handle body 18 to minimize wear and prolong the life of the door handle assembly. An inner end 54 of the handle shell 14 extends past the annular flange 40 in an axially-inward direction in spaced-apart parallel relation to hollow neck 28. An annular lip 56 integral with the distal end of inner end 54 extends in a radially inward direction toward the exterior surface of hollow neck 28 to lie in axially spaced-apart relation to the annular flange 40 of the handle body 18. As illustrated in FIG. 1, hollow neck 28, annular flange 40, handle shell 14, and annular lip 56 cooperate to define an annular space 58 for receiving a drive assembly 60.

Figure 3:
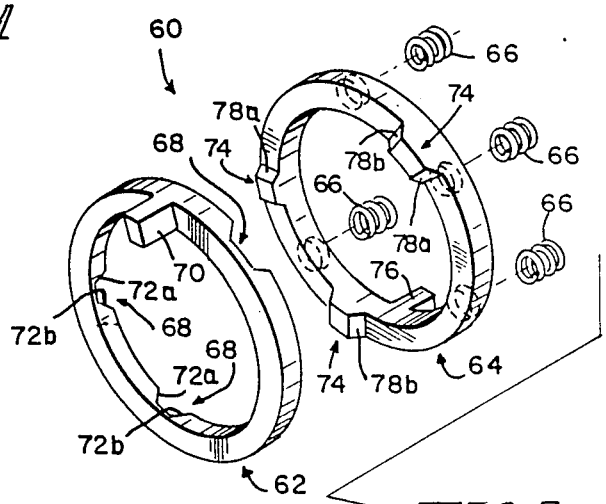
FIG. 3 is an exploded assembly view of the torque-releasable drive assembly illustrated in FIG. 1.
Figure 2:
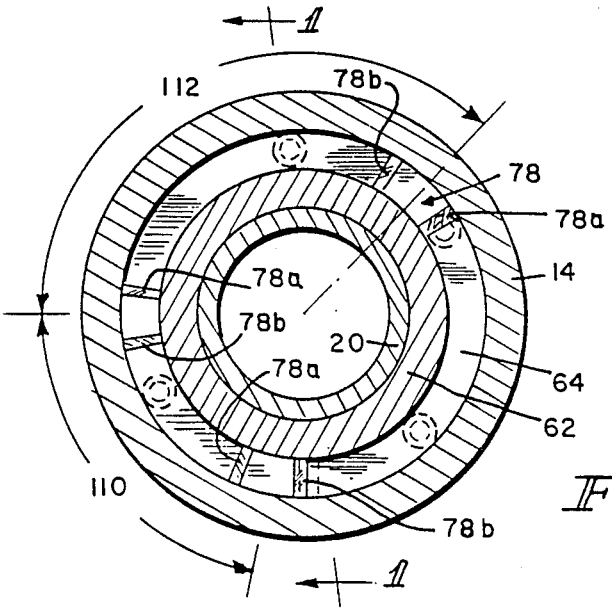
FIG. 2 is a transverse section on the line 2—2 of FIG. 1.

The novel drive assembly 60 is best seen in FIG. 3 and yieldably interconnects handle shell 14 and handle body 18. The drive assembly 60 includes a female drive ring 62, a complimentarily-shaped male drive ring 64, and a plurality of coiled springs 66. The female drive ring 62 includes a plurality of lug-receiving recesses 68 formed in one of its faces in circumferentially spaced-apart relation and a torque-transmitting handle body key 70 extending in an axially outward direction from the other of its faces. Each lug-receiving recess 68 has a pair of axially inwardly-diverging cam faces **72*a* and 72*b*. The male drive ring 64 includes a plurality of drive lugs 74 formed in one of its faces for engaging the lug-receiving recesses 68 and a torque-transmitting handle shell key 76 extending in an axially outward direction from the other of its faces. Each drive lug 74 is shaped to fit snugly into its companion lug-receiving recess 68 to provide a releasable interlock and includes a pair of axially outwardly-converging drive faces 78*a* and 78*b* for selectively engaging the cam faces 72*a* and 72*b*, respectively, of its companion lug-receiving recess 68** in driving relation.

As shown in FIG. 1, the female drive ring 62 is positioned within annular space 58 against the axially-inwardly facing surface 42 of annular flange 40 so that the torque-transmitting handle body key 70 of the female drive ring 62 is inserted into a key-receiving aperture 80 formed in annular flange 40 to couple the handle body 18 to the female drive ring 62 for rotation therewith. The male drive ring 64 is positioned within annular space 58 to present the drive lugs 74 toward the lug-receiving recesses 68 of the female drive ring 62. The torque-transmitting handle shell key 76 is inserted into another key-receiving aperture 82 formed in annular lip 56 to couple the male drive ring 64 to the handle shell 14 for rotation therewith. Importantly, the male drive ring 64 is axially reciprocable within annular space 58 between an inactive position shown in FIG. 4 in which the female and male drive rings 62, 64 are disengaged and a torque-transmitting position shown in FIG. 1 in which the female and male drive ring 62, 64 are engaged in driving relation.

The coiled springs 66 are positioned within annular space 58 between the male drive ring 64 and the annular lip 56 to yieldably bias the reciprocable male drive ring 64 toward its torque-transmitting position shown in FIG. 1. The coiled springs 66 are arranged about annular space 58 to apply a substantially uniform biasing pressure to the male drive ring 64. This uniform pressure along with the contour of the cam faces 72 and the drive faces 78 is an improvement over known torque-releasable driver assemblies in that the normal driving connection is more consistently released in response to application of a rotation-inducing torque to the handle 16 in excess of a threshold amount.

Referring to FIG. 1, a coupling member 84 is provided for the purpose of retaining the handle body 18 on the bolt-retracting knob sleeve 20. Coupling member 84 projects through a radial slot in sleeve 20 to engage an axially outwardly presented surface 86 of relatively thick portion 32. Reference is hereby made to U.S. Pat. No. 4,550,581 to Best et al., which shows a suitable means for coupling a bolt-retracting sleeve to a handle body for rotation therewith to actuate a door latch. It will also be appreciated that the '581 patent shows a handle shell and body fixed rigidly to one another by means of a pin 74.

An end closure member 88 is rotatably mounted in the axially outer end of the handle shell 14 to position a radially outwardly opening circumferential groove 90 in concentric registry with a radially inwardly opening circumferential groove 92 formed in the interior wall 50 of the handle shell 14. The end closure member 88 is rotatably locked in place by a buried ring 94 which has a portion engaged in the groove 92. The end closure member 88 is formed with a figure-8 opening 96 for the reception of a key-operated core 98 containing a key plug coaxial with the handle body 18 and connected to a throw member (not shown) to actuate a cam member (not shown) for retracting the latch bolt (not shown) of the lock mechanism. Reference is again made to U.S. Pat. No. 4,550,581 to Best et al., which shows a suitable alternative means of supporting an end closure member at an axially outer end of a handle shell.

Desirably, the end closure member 88 is formed with a rearwardly-extending circular flange 100 which is nonrotatably interlocked with the forward end of the knob sleeve 20. This rotative mounting of end closure member 88 interacts with the releasable drive connection between the handle shell 14 and the handle body 18, in that it permits the handle shell 14 to rotate relative to the end closure member 88 and hence relative to the core 98, knob sleeve 20, and handle body 18 when excessive torque breaks the torque-transmitting normal driving connection between the handle shell 14 and handle body 18.

In operation, the coiled springs 66 normally urge the male drive ring 64 toward the female drive ring 62 to engage the drive lugs 74 into their companion lug-receiving recesses in torque-transmitting relation as shown in FIG. 1 to establish the normal driving connection between the handle shell 14 and handle body 18. In this circumstance, application of a rotation-inducing torque to the handle shell 14 via lever 16 or the like causes the handle body 18 to rotate by means of a torque-transmitting connection established by the drive assembly 60 which, in turn, causes the bolt-retracting sleeve 20 to rotate to a latch bolt-actuating position (not shown) by means of a torque-transmitting connection established by coupling member 84.

Figure 4:
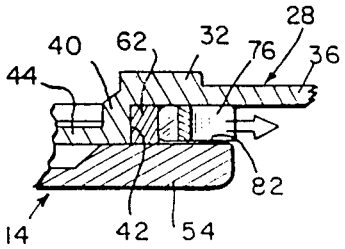
FIG. 4 is an enlarged view of a portion of the drive assembly illustrated in FIG. 1 showing the reciprocable drive ring in its retracted torque-releasing position.

In the event that a torque is applied to the handle shell 16 during an attack on the security of the lock or other improper usage of the lock that exceeds a predetermined torque, the male drive ring 64 will be cammed against the coiled springs 66 to a retracted, inactive position as shown in FIG. 4, thereby releasing the normal driving connection between the handle shell 14 and the handle body 18 without substantially affecting the coupling between the handle body 18 and the bolt-retracting sleeve 20. Provision of pairs of oppositely facing cam faces 72 and drive faces 78 permit the male drive ring 64 to be cammed to a disengaged position in response either to clockwise or counterclockwise rotation of the handle shell 14. It will be appreciated that the threshold torque defining the predetermined amount is a function of the shape and slope of the cam faces 72 and drive faces 78, and also the amount of biasing force exerted by the coiled springs 66.

In a case of a handle shell 14 having a lever 16, the necessity of returning that lever 16 to its initial orientation with respect to the door will be appreciated. As shown best in FIGS. 2 and 3, the novel drive assembly 60 of the present invention is easily adaptable using a combination of features to accomplish such a result. The "interlocks" defined by each companion pair of lug-receiving recesses 68 and drive lugs 74 can be spaced unevenly about the circumference of the drive rings 62, 64 in matching relation to define a single lever orientation. Compare, for example, uneven spacings 102 and 104 in FIG. 2. Other means include varying the size and shape of the lug-receiving recesses 68 and drive lugs 74. For example, provision of a lug-receiving recess 68 that is more shallow than the other recesses 68 and a "short" drive lug 74 shaped to complement the shallow recess 68 will result in a single engagement position since the comparatively larger drive lugs 74 will be unable to seat properly in the shallow lug-receiving recess 68. By the same token, provision of a drive lug 74 that is substantially larger than the other drive lugs 74 and a "deep" lug-receiving recess 68 shaped to complement the larger drive lug 74 will also result in a single engagement position since the one larger drive lug 74 will only be able to seat properly in the "deep" recess 68. Advantageously, any one or a combination of the foregoing structures can be incorporated into the novel drive assembly 60 of the present invention to prevent improper repositioning of the lever handle 16 with respect to the door after torque-override of the handle shell 14 relative to the handle body 18.

To assemble the lock mechanism in FIGS. 1–4, the door handle 12 is positioned for assembly by rotating it 90° from that shown in FIG. 1 with the handle shell 14 standing vertically and the operating lever 16 at the top and extended to the left.

The three coiled springs 66 are inserted into handle shell 14 and placed in their respective pockets provided in adjacent annular lip 56. With the springs 66 in position, male drive ring 64 is inserted into handle shell 14 and positioned to rest on the free ends of springs 66. Male drive ring 64 is then rotated so as to position key 76 in alignment with aperture 92. Likewise, female drive ring 62 also is placed inside handle shell 14 so as to mate with male drive ring 64 and nest with its lug-receiving recesses 68 over drive lugs 74. Key 70 extends upwardly to receive the now-to-be-inserted handle body 18.

As handle body 18 is inserted into handle shell 14, its thin portion 36 passes through the central aperture of rings 64, 62, and between the circumferentially spaced-apart springs 66. Handle body 18 extends out of handle shell 14 to permit key-receiving aperture 80 in flange 40 to nest with key 70. Handle body 18 is axially locked in position by way of outwardly biased coupling 84 in sleeve 20.

Once retaining ring 94 is placed in groove 92, end enclosure member 88 is inserted into handle shell 14 and into sleeve 20. Such insertion is complete when end enclosure member 88 abuts circular end face 46 of handle body 18 and buried retaining ring 94 expands outwardly into groove 90. Thus, retaining ring 94 traps the entire assembly and holds it against annular lip 56. Finally, core 98 can be inserted into figure-8 opening 96 to complete the assembly of the embodiment of FIGS. 1–4.

Figure 5:
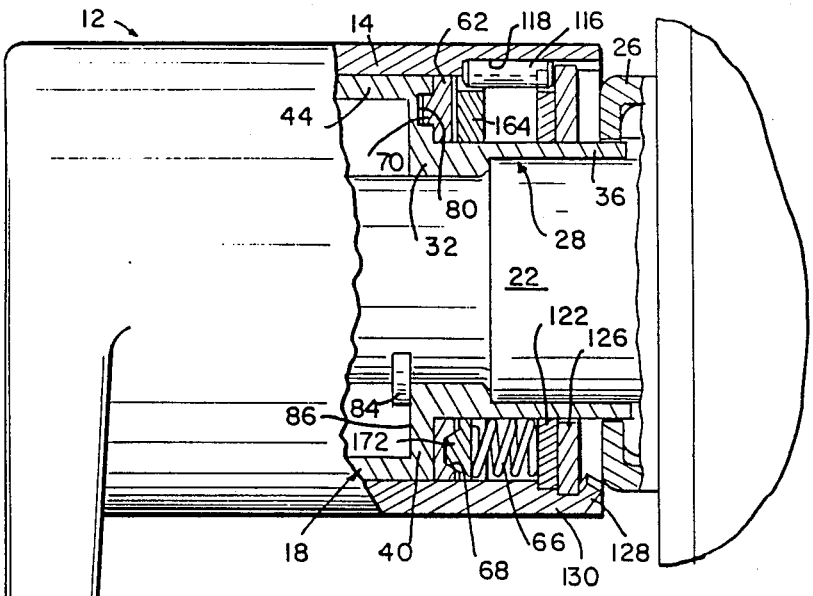
FIG. 5 is a side elevation view of a cylindrical lock mechanism, with portions broken away, to reveal a second embodiment of the present invention showing a reciprocable drive ring in its normal driving position.
Figure 6:
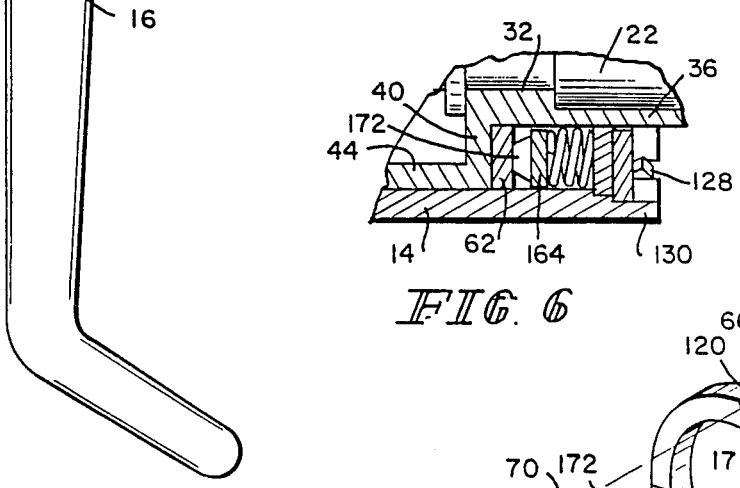
FIG. 6 is an enlarged detail view of a portion of the drive assembly illustrated in FIG. 5, showing the reciprocable drive ring in its retracted torque-releasing position.
Figure 7:
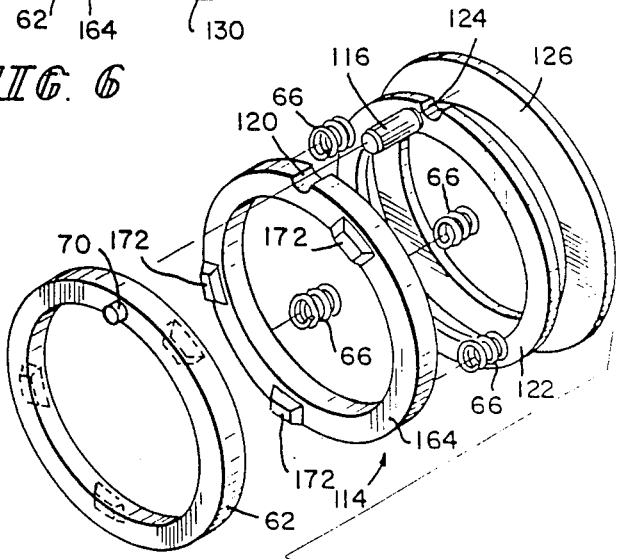
FIG. 7 is an exploded assembly view of the drive assembly illustrated in FIG. 5 showing one embodiment of a male drive ring.
Figure 8:
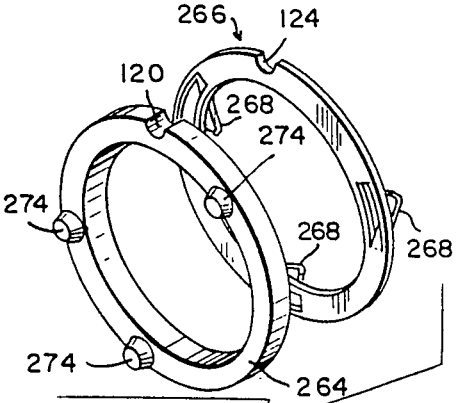
FIG. 8 is a perspective view of another embodiment of a male drive ring for use with the present invention.

In the embodiments of FIGS. 5–8, those elements having reference numerals identical to those in the embodiment of FIGS. 1–4 perform the same or substantially similar function. Three alternative male drive ring configurations 64, 164, and 264 are illustrated in FIGS. 3, 7, and 8, respectively. It will be appreciated that a variety of shapes can be selected for the lug-receiving recesses and the companion drive lugs. Two different trapezoidal drive lug shapes (74, 174) are illustrated in FIGS. 3 and 7 and a conical drive lug shape (274) is illustrated in FIG. 8. In each case, the lug-receiving recesses are shaped to complement the shape of the drive lugs. Apart from manufacturing techniques, the major difference among these shapes in terms of performance is that the embodiment of FIG. 3 provides the greatest camming interface while the embodiment of FIG. 8 provides the least camming interface. Thus, it is expected that maximum wear-resistance might result by selecting the lug/recess embodiment shown in FIG. 3.

Referring to FIGS. 5, 6, and 7, it will be seen that, in one of the embodiments, the male drive ring 164 is a part of a subassembly 114 which is keyed to the handle shell 14 by means of an antirotation pin 116. In particular, the interior wall 50 of the handle shell 14 is formed to include an axially-extending elongated pin-receiving slot 118 as shown in FIG. 5. The subassembly 114 includes a male drive ring 164 formed to include a pin-receiving slot 120, an annular spring plate 122 formed to include a pin-receiving slot 124, and an annular reinforcing plate 126. When assembled, the antirotation pin 116 is positioned in slot 118 of the handle shell 14, forward slot 120 of male drive ring 164, and rearward slot 124 of spring plate 122 to inhibit rotation of subassembly 114 in relation to the handle shell 14. A plurality of radially-inwardly canted members 128 are formed along the periphery of inner end 130 to trap the nonrotatable subassembly 114 within the space between the handle shell 14 and the handle body 18. It will be understood that the embodiments of FIGS. 5–7 and FIG. 8 operate in substantially the same manner as the embodiment of FIGS. 1–4.

An alternative biasing means 266 is illustrated in FIG. 8 which may be used in lieu of the plurality of springs 66 shown in the embodiments of FIGS. 1–4 and 5–7. In particular, ring member 266 can be made of a resilient spring material and formed to include a plurality of circumferentially spaced undulations 268. One advantage of ring member 266 is ease of assembly.

The following assembly description relates to the embodiment of FIGS. 5–8. The handle body 18 is assembled into the door handle 12 shown in FIG. 5 and locked in axial position by end closure member 88 (not shown in FIG. 5). The door handle 12 is then rotated 90° counterclockwise from that shown in FIG. 5 for assembly. The driver assembly illustrated in FIG. 7 is then stacked into handle shell 14 through the open end opposite mounted end closure member 88. Closure and axial retention of the assembly is achieved by stacking with canted members 128 against plate 126.

Although the invention has been described in detail with reference to certain preferred embodiments, variations and modifications exist within the scope and spirit of the invention as described and defined in the following claims.

What is claimed is:

1. A torque-releasable door handle assembly for normally rotating a bolt-retracting sleeve to operate a door latching system, the door handle assembly comprising a body for coupling to the door latching system, a handle shell mounted on the body for rotational movement thereabout, and drive means for yieldably interconnecting the body and the handle shell to establish a normal driving connection so that the body is rotated to rotate the bolt-retracting sleeve and operate the door latching system in response to rotation of the handle shell, the drive means being configured to release the normal driving connection between the body and the handle shell in response to application of a rotation-inducing torque to the handle shell in excess of a predetermined amount, the drive means including a matched pair of mateable clutch rings and means for retractably urging one of the clutch rings into torque-transmitting engagement with the other of the clutch rings so that said one of the clutch rings is retracted against the urging means to release the normal driving connection in response to application of excessive rotation-inducing torque to the handle sheel, the urging means including first means for coupling said one of the clutch rings to the handle shell for rotation therewith, second means for coupling said other of the clutch rings to the body for rotation therewith, and at least one spring acting against the handle shell normally to urge said one of the clutch rings toward its torque-transmitting position.

2. The door handle assembly of claim 1, wherein the drive means includes a female drive ring formed to include at least one lug-receiving recess and a separate companion male drive ring having at least one drive lug configured to fit the at least one lug-receiving recess in driving engagement therewith.

3. The door handle assembly of claim 2, wherein the handle shell includes a lever handle for rotating the handle shell about the body to actuate the door latching system, and the female and male drive rings are formed to interengage in only one relative position to establish a single normal orientation of the lever handle.

4. The door handle assembly of claim 2, wherein the body and handle shell cooperate to define a space for receiving the female and male drive rings, the second coupling means couples the female drive ring to the body for rotation therewith in the space, the first coupling means couples the male drive ring to the handle shell for rotation therewith in the space to present the at least one drive lug toward the at least one lug-receiving recess of the female drive ring, and the male drive ring is reciprocable within the space in an axial direction between an engaged position establishing the normal driving connection between the body and the handle shell and a disabled position permitting substantially free rotation of the handle shell relative to the body in at least one of a clockwise and counterclockwise direction.

5. The door handle assembly of claim 4, wherein the drive means further includes spring means for yieldably biasing the male drive ring from its disabled position toward its engaged position.

6. The door handle assembly of claim 4, wherein the at least one lug-receiving recess is configured to cam the male drive ring from its engaged position toward its disabled position in response to application of excessive rotation-inducing torque to the handle shell.

7. The door handle assembly of claim 4, wherein the at least one drive lug is configured to cam the male drive ring from its engaged position toward its disabled position in response to application of excessive rotation-inducing torque to the handle shell.

8. The door handle assembly of claim 6, wherein each lug-receiving recess is configured to define opposing clockwise and counterclockwise cam faces, each drive lug is configured to define oppositely-facing clockwise and counterclockwise drive faces, the drive means further includes means for retractably urging the male drive ring from its disabled position toward its engaged position causing the companion clockwise cam and drive faces and the companion counterclockwise cam and drive faces to mate and establish the normal driving connection, and the cam and drive faces are inclined at predetermined slopes to displace the male drive ring axially within the space during clockwise or counterclockwise rotation thereof toward its disabled position to release the normal driving connection in response to application of excessive rotation-inducing torque to the handle shell.

9. The door handle assembly of claim 1, wherein said one of the cluch rings is coupled to the handle shell by said first means to define a space between said one of the clutch rings and the handle shell and said at least one spring is positioned in said space to act between said other of the clutch rings and the handle shell.

10. A torque-releasable door handle assembly for operating a door latching system, the door handle assembly comprising body means for rotatably actuating the door latching system, the body means including a contoured camming surface, a handle shell mounted on the body means for rotational movement thereabout, and drive means for normally engaging the contoured camming surface to establish a torque-transmitting connection between the body means and the handle shell, the drive means including means for riding on the contoured camming surface and spring means for yieldably urging the riding means against the camming surface in torque-transmitting relation, the contoured camming surface, riding means, and spring means cooperating to release the torque-transmitting connection in response to application of a rotation-inducing torque to the handle shell in excess of a predetermined amount, the contoured camming surface being formed to include a plurality of lug-receiving recesses having a pair of side walls, the riding means including a plurality of companion drive lugs having a pair of drive faces for engaging the inclined side walls of the lug-receiving recesses.

11. The door handle assembly of claim 10, wherein the side walls and the drive faces are inclined at predetermined slopes to remain in torque-transmitting engagement only during application of a rotation-inducing torque to the handle shell that is less than or equal to the predetermined amount so that the torque-transmitting connection is released under excessive torque.

12. The door handle assembly of claim 10, wherein the pairs of lug-receiving recesses and companion drive lugs are arranged in an uneven spaced-apart relation to define a predetermined pattern to aid in preventing improper repositioning of the handle shell on the body means during an attempt to reestablish torque-transmitting engagement of the drive lugs in the lug-receiving recesses following a release of the torque-transmitting connection under excessive torque.

13. A torque-releasable door handle assembly for operating a door latching system, the door handle assembly comprising body means for rotatably actuating the door latching system, the body means including a contoured camming surface, a handle shell mounted on the body means for rotational movement thereabout, and drive means for normally engaging the contoured camming surface to establish a torque-transmitting connection between the body means and the handle shell, the drive means including means for riding on the contoured camming surface and spring means for yieldably urging the riding means against the camming surface in torque-transmitting relation, the contoured camming surface, riding means, and spring means cooperating to release the torque-transmitting connection in response to application of a rotation-inducing torque to the handle shell in excess of a predetermined amount, the contoured camming surface being formed to include a plurality of lug-receiving recesses having a pair of side walls, the riding means including a plurality of companion drive lugs having a pair of drive faces for engaging the inclined side walls of the lug-receiving recesses, at least one of the plurality of lug-receiving recesses and the plurality of drive lugs being configured to provide only one companion drive lug for each lug-receiving recess, thereby defining only one torque-transmitting orientation of the riding means relative to the body means to said in preventing improper repositioning of the handle shell of the body means during an attempt to reestablish torque-transmitting engagement of the drive lugs in the lug-receiving recesses following a release of the torque-transmitting connection under excessive torque.

14. The door handle assembly of claim 13, wherein at least one of the lug-receiving recesses has a depth that is substantially more shallow than the other lug-receiving recesses to permit torque-transmitting engagement of the drive lugs in the lug-receiving recesses only in said one torque-transmitting orientation.

15. The door handle assembly of claim 13, wherein at least one of the drive lugs has a size that is substantially larger than the other drive lugs to permit torque-transmitting engagement of the drive lugs in the lug-receiving recesses only in said one torque-transmitting orientation.

16. A torque-releasable door handle assembly for operating a door latching system, the door handle assembly comprising a hollow body for coupling to the door latching system, the hollow body including an axially outer cylindrical portion having an interior wall, an axially inner cylindrical portion having an exterior wall and a diameter smaller than the diameter of the axially outer cylindrical portion, and an annular surface interconnecting the axially outer and inner cylindrical portions, a handle including a hollow shell and a lever projecting outwardly thereform, the hollow shell having a cylindrical side wall coupled to the axially outer cylindrical portion in rotative bearing engagement and a lip projecting in a radially inwardly-extending direction toward the axially inner cylindrical portion, the exterior wall of the axially inner cylindrical portion, the annular surface, the interior wall of the axially outer cylindrical portion, and the lip cooperating to define an axially-extending annular space therebetween, a female drive ring formed to include a plurality of lug-receiving recesses, the female drive ring being positioned in the axially-extending space in close proximity to the annular surface to present the lug-receiving recesses toward the lip, first means for coupling the female drive ring to the body means for rotation therewith, a male drive ring including a plurality of drive lugs shaped to engage the lug-receiving recesses, the male drive ring being positioned in the axially-extending space to project the drive lugs toward the lug-receiving recesses of the female drive ring, second means for coupling the male drive ring to the handle for rotation therewith, the male drive ring being reciprocable in the axially-extending space between an inactive position in spaced relation to the female drive ring and a torque-transmitting position in engagement with the female drive ring, and spring means for yieldably biasing the male drive ring toward its torque-transmitting position to establish a normal driving connection between the hollow body and the handle, the male drive ring being moved against the spring means toward its inactive position to release the normal driving connection in response to application of a rotation-inducing torque to the handle in excess of a predetermined amount.

17. The door handle assembly of claim 16, wherein the pairs of lug-receiving recesses and companion drive lugs are unevenly spaced apart in matching relation about the circumference of the female and male drive rings normally to project the lever in a predetermined orientation relative to the hollow body in the absence of an applied torque to the handle when the male drive ring is in its torque-transmitting position.

18. The door handle assembly of claim 16, wherein the annular surface is formed to include a tab-receiving slot and the first coupling means is provided by a tab on the female drive ring, the tab projecting in an axial direction to engage the tab-receiving slot.

19. The door handle of claim 16, wherein the lip is formed to include a tab-receiving slot and the second coupling means is provided by a tab on the male drive ring, the tab projecting in an axial direction to engage the tab-receiving slot.

20. The door handle of claim 19, wherein the spring means acts between the male drive ring and the lip.

21. The door handle assembly of claim 16, wherein the male drive ring includes a pin-receiving notch, the interior wall of the hollow shell includes an axially-extending pin-receiving notching presented in opposed relation to the pin-receiving notch of the male drive ring, and the second coupling means includes a pin received in said notches to block rotation of the male drive ring relative to the handle while permitting the male drive ring to reciprocate in either axial direction within the axially-extending space.

22. The door handle assembly of claim 21, wherein the spring means includes a spring pad ring positioned in the axially-extending space intermediate the male drive ring and the lip, the spring pad ring including a peripheral notch for receiving the pin to block rotation of the spring pad ring relative to the handle, and at least one spring acting between the male drive ring and the spring pad ring.

23. The door handle assembly of claim 16, wherein the plurality of lug-receiving recesses cooperate to define a female engagement surface on the female drive ring, the plurality of drive lugs cooperate to define a complementary male engagement surface on the male drive ring, and the male and female engagement surfaces are configured to interengage in only one relative position and establish a single normal orientation of the lever so that the lever is rotatable about the body during camming of the male drive ring to its inactive position without actuating the door latching system until the lever is returned to its single normal orientation.

* * * * *

UNITED STATES PATENT AND TRADEMARK OFFICE

CERTIFICATE OF CORRECTION

PATENT NO. : 4,773,240

DATED : September 27, 1988

INVENTOR(S) : William R. Foshee

It is certified that error appears in the above-identified patent and that said Letters Patent is hereby corrected as shown below:

At column 9, line 33, please delete "6" and insert therefor --4--;

At column 10, line 61, delete "said" and insert therefor --aid--; and

At column 11, line 23, delete "thereform" and insert therefor --therefrom--.

Signed and Sealed this

Fourteenth Day of February, 1989

*Attest:*

DONALD J. QUIGG

*Attesting Officer*

*Commissioner of Patents and Trademarks*